United States Patent [19]

Itoh

[11] Patent Number: 4,796,305

[45] Date of Patent: Jan. 10, 1989

[54] GARMENT

[76] Inventor: Mitsuru Itoh, 23-12, Chu-ou 1-chome, Edogawa-ku, Tokyo, Japan

[21] Appl. No.: 110,877

[22] Filed: Oct. 21, 1987

[30] Foreign Application Priority Data

Nov. 13, 1986 [JP] Japan ..... 61-268700

[51] Int. Cl.[4] ..... A41D 1/00

[52] U.S. Cl. ..... 2/97; 112/98; 112/255; 112/272

[58] Field of Search ..... 2/98, 272, 255, 97

[56] References Cited

U.S. PATENT DOCUMENTS

| | | | |
|---|---|---|---|
| 2,923,945 | 2/1960 | Verlengia | 2/255 X |
| 3,098,235 | 7/1963 | Gusman | 2/97 X |
| 3,488,775 | 1/1970 | Dickenherr | 2/98 |
| 3,725,954 | 4/1973 | Baldini | 2/98 X |
| 3,812,540 | 5/1974 | Pagano | 2/97 |
| 4,521,921 | 6/1985 | Bregatta | 2/97 X |
| 4,555,428 | 11/1985 | Cole | 2/272 |
| 4,596,616 | 6/1986 | Noda et al. | 2/272 |

FOREIGN PATENT DOCUMENTS

| | | |
|---|---|---|
| 57-34528 | 2/1982 | Japan . |
| 60-40423 | 3/1985 | Japan . |

*Primary Examiner*—Ronald Feldbaum
*Attorney, Agent, or Firm*—Lorusso & Loud

[57] ABSTRACT

A garment has a collar llapel which is produced by folding a part of the boundary area between a body piece and a flyback. A first expansible and contractible interfacing member is fitted to an area of the body which becomes the rear side of the collar llapel when it is folded but no interfacing is fitted to the area of the flyback which becomes the front side of the collar llapel when it is folded. A second expansible and contractible interfacing member is fitted to the area of the flyback which becomes a rear side of the collar when it is folded. A stitch by means of which the first expansible and contractible manner is sewn to the body is provided in the proximity of the position where the first expansible and contractible interfacing member fitted to the body is folded as a collar. Another switch by means of which the second expansion and contractible interfacing member is sewn to the flyback is provided in the proximity of the position where the second expansible and contractible interfacing member fitted to the flyback is folded as a collar. A free end part of the first expansible and contractible interfacing member and a free end part of the second expansible and contractible member are joined to one another with the aid a switch or adhesive.

5 Claims, 7 Drawing Sheets

GARMENT

BACKGROUND OF THE INVENTION

The present invention relates to a garment of the type including a collar/lapel which is formed by folding a part of the boundary area between a body and a flyback and more particularly to a garment which assures that the collar and lapel will not loose its shape and will not bend backwardly.

Generally, a garment of the type including a collar which is formed by folding the boundary area of a seam between a body and a flyback is produced using flexible cloth material as base material. However, it is difficult to form the collar in good shape by using merely such flexible cloth material. For this reason there is already provided a garment which is produced by fitting a bias interfacing to an area which will become a collar later, in order to form a collar which will not loose its shape with the aid of the bias interfacing, as disclosed in, for instance, Japanese Utility Model Laid-Open Nos. 34528/19982 and 40423/1985.

Heretofore, the bias interfacing usable for the purpose of maintaing the shape of the collar is fitted to the whole area of the flyback. This is because of the fact that when a bias interfacing is fitted to the body, the latter becomes hard and thereby lacks flexibility. Moreover, the shape of the body can be well maintained by fitting a bias interfacing to the flyback.

However, when a bias interfacing is fitted to the whole area of a flyback and a collar/lapel is then formed by folding back the area where the flyback and the body are superimposed one above another, the flyback side having the interfacing fitted thereto appears on the front surface of the collar/lapel and the body side of cloth material becomes the rear side of the collar/lapel. As a result, the bias interfacing which is more rigid then cloth material functions to bias the collar toward its original state, causing the collar/label to bend inversely.

Further, since the part having the bias interfacing fitted thereto is located on the front surface of the collar, the latter does not have a soft appearance.

SUMMARY OF THE INVENTION

The present invention has been made with the foregoing background in mind and its object resides in providing a garment which is so constructed that an area of the flyback which becomes a front surface side of the collar/lapel is constituted of only cloth material and an expansible and contractible interfacing is fitted to part of the body which becomes the rear surface of the collar/lapel so that a shape of the collar/lapel is maintained while softness of the cloth material is maintained.

Another object of the present invention is to provide a garment which prevents the collar from bending inversely by joining the edge of the expansible and contractible interfacing on the flyback side to the edge of the expansible and contractible interfacing on the front piece.

Another object of the presdent invention is to provide a garment which is so constructed that a joint cloth which is independent of the first expansible and contractible interfacing is fitted to the flyback side, another joint cloth which is independent of the second expansible and contractible interface is fitted to the body side and these joint cloths are joined together in order to improve workability.

To accomplish the above objects, the present invention provides a garment of the type including a collar which is formed by folding a part of the boundary area between a body and a flyback, wherein a first expansible and contractible interfacing member is fitted to an area of the body which becomes a rear side of the collar when it is folded and no interfacing is fitted to an area of the flyback which becomes a front side when folded. A second expansible and contractible interfacing member is fitted to an area of the flyback which becomes a rear side when folded over. stitching, by means of which the first expansible and contactible interfacing member is sewn to the body, is provided in the proximity of the of the fold for the collar/lapel, stitching by means of which the second expansible and contractible interfacing member is sewn to the flyback is provided in the proximity of the fold for the collar/lapel, and a free end part of the first expansible and contractible interfacing member and a free end part of the second expansible and contractible interfacing member are joined to one another with the aid of a stitch or adhesive.

With respect to the flyback no expansible and contractible interfacing is fitted to that area which becomes the front surface of the collar/lapel but an expansible and contractible interfacing is fitted to that area which does not become the front surface of the collar/lapel. On the other hand, with respect to the front piece an expansible and contractible interfacing is fitted to that area which becomes the rear surface of the collar but no other area. This leads to the result that the surface on the front side of the collar is a cloth material and thereby the softness of the cloth material is retained in the finished collar of the coat. On the other hand, cloth material having expansible and contractible interfacing adherred thereto forms the rear surface of the collar so that a shape of the collar is maintained.

Further, expansible and contractible interfacing is fixed to the front piece by means of a stitch and expansible and contractible interfacing is fixed to the flyback by means of a stitch and free ends of the expansible so as to leave contractible interfacings joining together with the aid of a stitch or adhesive. This causes the front body and the flyback to be joined, resulting in the shape of the collar being stabilized.

By folding back the free end part of the expansible and contractible interfacing fitted to the flyback between the stitch and the edge and then sewing the expansible and contractible interfacing on the body side to the folded part of the interfacing, the folded part prevents the collar from being bent backwardly.

Other objects, features and advantages of the present invention will become readily apparent from a reading of the following description in conjunction with the accompanying drawings.

BRIEF DESCRIPTION OF THE DRAWINGS

The present invention is illustrated by the accompanying drawings in which:

FIG. 1 is a view illustrating cloth material pieces for the garment in a disassembled state;

FIG. 2 is a perspective view illustrating the cloth material pieces for the garment in FIG. 1 in a folded state, ready for sewing;

FIG. 3 is an enlarged cross-sectional view taken along line A—A in FIG. 2;

FIG. 4 is a front view illustrating in an opened state the cloth material pieces which have been sewn from the state as shown in FIG. 2;

FIG. 5 is a front view illustrating the garment which is obtained by folding the front piece from the state as shown in FIG. 4;

FIG. 6 is a view illustrating cloth material pieces for the garment in a disassembled state;

FIG. 7 is an enlarged cross-sectional view taken in line B—B in FIG. 6 illustrating a front piece fitted to a flyback at their outer edge;

FIG. 8 is a froint view illustrating in an opened state the cloth material pieces which are sewn along their outer edge from the state as shown in FIG. 6;

FIG. 9 is a front view illustrating the garment which is obtained by folding the front piece from the state as shown in FIG. 8.

DESCRIPTION OF THE PREFERRED EMBODIMENTS

Now, the present invention will be described in a greater detail hereunder with reference to the accompanying drawings which illustrate three preferred embodiments.

(First Embodiment)

Figure 1:
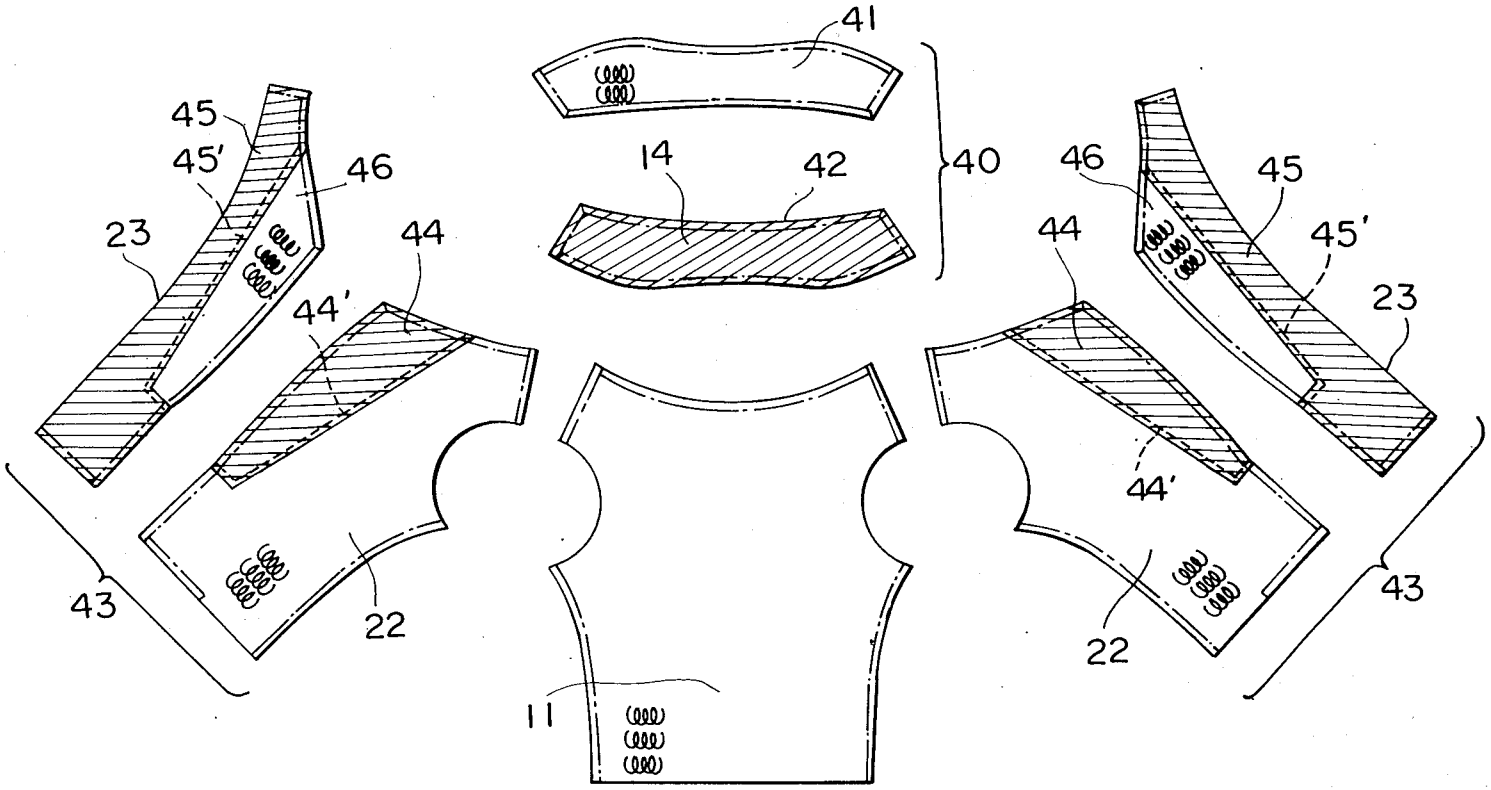
FIGS. 1 to 5 illustrate a garment in accordance with a first embodiment of the present invention.
Figure 2:
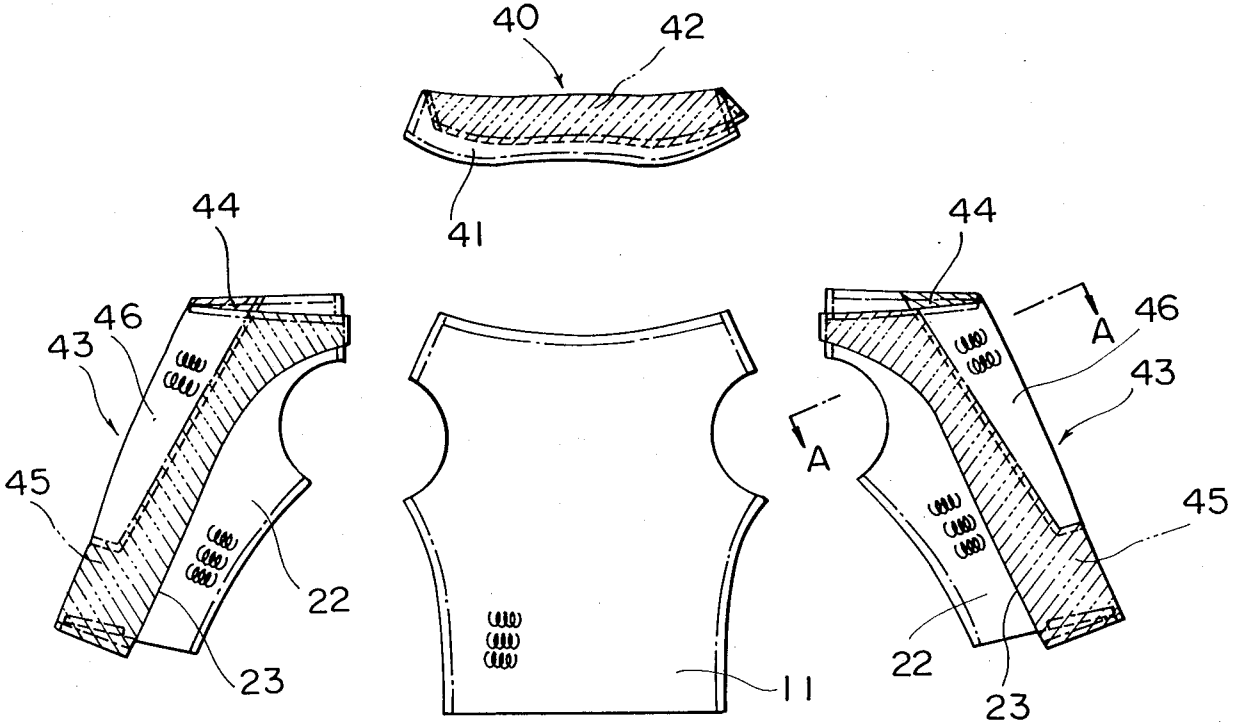
Figure 3:
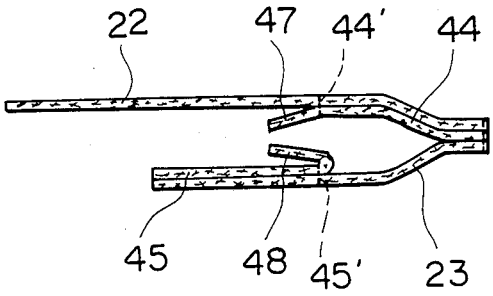
Figure 4:
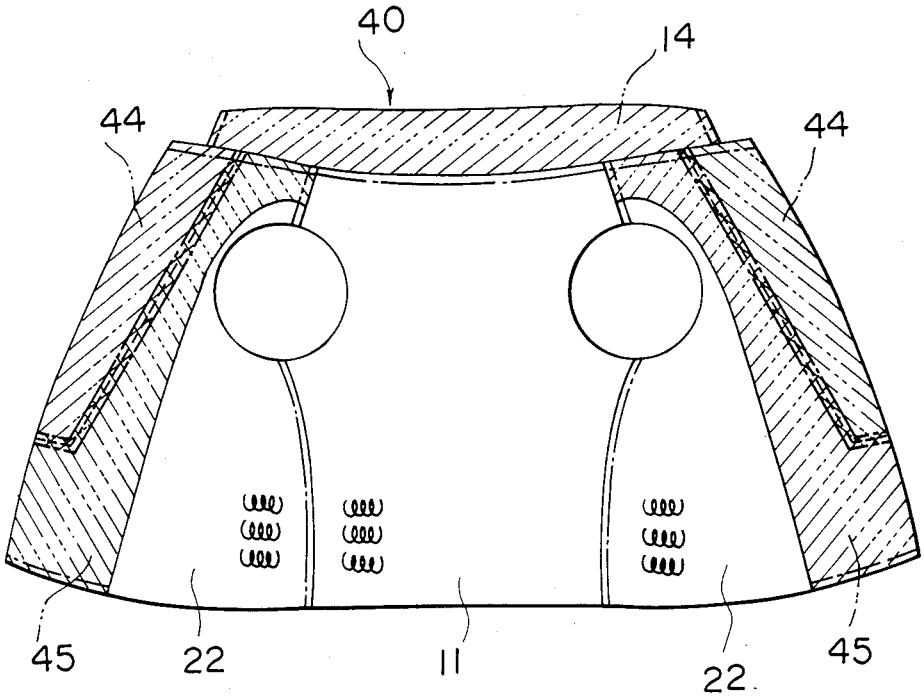
Figure 5:
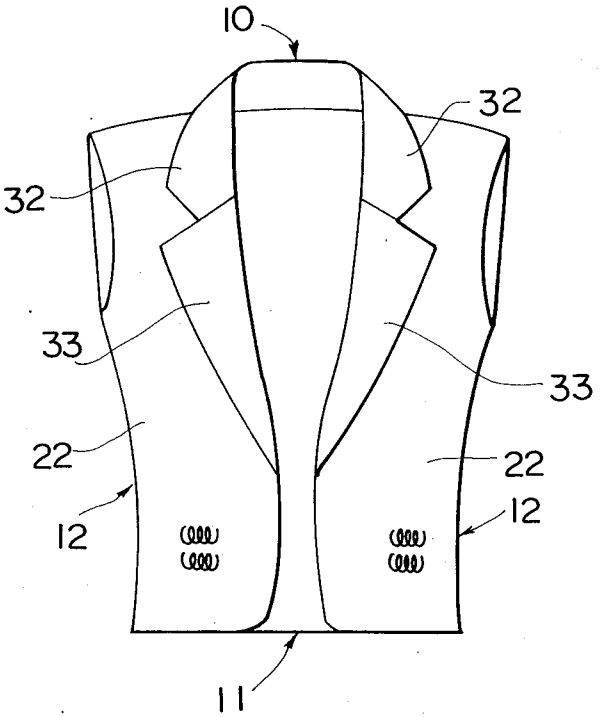

Description will be made below with reference to FIGS. 1 to 5. FIG. 1 illustrates a plurality of cloth pieces constituting a garment of the present invention in a disassembled state. FIG. 2 illustrates by way of a perspective view some of the cloth pieces shown in FIG. 1 which are folded for sewing. FIG. 3 is an enlarged cross-sectional view of the cloth pieces taken along line A—A in FIG. 2. FIG. 4 is a front view of the cloth pieces which are sewn from the arrangement as shown in FIG. 2, the cloth pieces being shown in an opened state. FIG. 5 is a front view of a garment including front sections which are folded from the state as shown in FIG. 4.

The garment is composed of four cloth material pieces comprising a collar piece 40, a back body section 11 which forms the back portion of the garment and a pair of front body sections 43. The cloth material used for the garment may be any suitable garment material such as knit fabric or the like. The collar section 40 is composed of a first collar piece 41 and a second collar piece 42 both of which have the same shape, and the first collar piece 41 and the second collar piece 42 are sewn together along their length. The front body sections 43 are each composed of a front piece 22 and a flyback 23, and the front piece 22 and the flyback 23 are also sewn together lengthwise. It should be noted that the first collar piece 41 and the second collar piece 42 may be integrally formed without any separation and the front piece 22 and the flyback 23 may be integrally formed without any separation as is the case with the illustrated embodiment.

A difference between the garment of the invention and a conventional one is in the position where an expansible and contractible interfacing, for maintaining the shape of the garment, is fitted. The interfacing used for the garment of the invention, allows expansibility and contractibility of the garment to be maintained and also maintains the shape of the garment. This expansible and contractible interfacing is not limited to a bias interfacing but any interfacing such as knit fabric (having a comparatively small mesh size compaired with cloth material), felt (unwoven cloth) or the like which serves the function of allowing cloth material to restore to its original state after it expands may be used for the garment. Firstly, with respect to the collar section 40, an expansible and contractible interfacing 14 (an area represented by hatched lines) is fitted to the second collar piece 42 which becomes the rear surface of an upper collar 32 (as shown in FIG. 5) but no expansible and contractible interfacing is fitted to the first collar piece 41 which becomes the outer surface of the upper collar. This expansible and contractible interfacing 14 is fitted to the second collar piece 42 in such a manner that it is located on the inner side when it is folded as shown in FIG. 2.

Next, with respect to the front section 22 a first expansible and contractible interfacing 44 (an area represented by hatched lines—located on the outer side as seen in FIG. 1) is fitted to the upper portion of front section 22 in the proximity of the side portion which will be joined to the flyback 23. On the flyback 23 is a second expansible and contractible interfacing 45 (an area represented by hatched lines as seen in FIG. 1) covers an area exclusive of an upper area 46 located in the proximity of the side which will be joined to the front piece 22. The first expansible and contractible interfacing 44 and the second expansible and contractible interfacing 45 are fitted to the front section 22 and the flyback 23 in such a manner that they are located on the inside of the garment as shown in FIG. 2. The size of the lower collar (lapel) 33 (shown in FIG. 5) which is formed of a combination of the front piece 22 and the flyback 23 corresponds to the size of the first expansible and contractible interfacing 44 of the front piece 22, that is, the size of the area 46 of the flyback 23. As shown in FIG. 2, the first expansible and contractible interfacing 44 is secured to the front piece 22 with a L-shaped stich 44' at a position appreciably inwardly of the edge of the front piece 22 in order to assure that it does not part from the front piece 22. Also, the second expansible and contractible interfacing 45 is secured with a L-shaped stitch 45' at a position appreciable inwardly of the edge of the flyback 23 in order to assure that it does not part from the flyback 23.

Thus, as shown in FIG. 3, the first expansible and contractible interfacing 44 on the front piece 22 is formed with a first free end piece 47 by stitch 44'. The free end piece 47 extends from the position of the stitch 44' to the edge of the first expansible and contractible interfacing 44. The second expansible and contractible interfacing 45 on the flyback 23 is formed with a second free end piece 48 by stitch 45'. The free piece 48 extends from the position of the stitch 45' to the edge of the second expansible and contractible interfacing 45. As is apparent from the drawing, the first free end piece 47 and the second free end piece 48 are sewn in such a manner that the first free end piece 47 extends from the edge of the first expansible and contractible interfacing 44 while the second interfacing piece 48 is folded back at the stitch 45'. Namely, at a position in the proximity of the stitches 44' and 45' the front body 22 and the flyback 23 are sewn directly together. It is preferable that the stitch 44' and the stitch 45' join one another by scoop stitch sewing from the interfacing piece side. When any stitch is fitted by scoop stitch sewing, the part of the stitch on the surface of the coat can be hardly recognized.

By sewing with the second free end piece 48 bent, the second free end piece 48 exerts a spring force such that the flyback 23 is biased forward.

The first free end piece 47 and the second free end piece 48 are sewn together to join the front piece 22 to the flyback 23 in order to assure that the former does not part away from the latter. If stitch 45 is directly between the front body 22 and the flyback 23, the result is that the front body and the flyback 23 do not have a degree of freedom. However, by sewing the first free end piece 47 and the second free end piece 48, the front piece 22 and the flyback 23 can be joined to one another while maintaining their flexibility.

Incidentally, the first expansible and contractible interfacing 44 and the second expansible and contractible interfacing 45 may be adhesive interfacings respectively in order that they may be fitted to the front piece 22 and the flyback 23 with the use of an adhesion. Further, the first free end piece 47 and the second free end piece 48 may be adhesive interfacings of the type respectively which allows that those surfaces facing one another can be adhesively joined.

When sewing margins, the cloth materials are sewn together after the first free end piece 47 and the second free end piece 48 are sewn together in the above-described manner, the thus obtained half-finished garment assumes a state as shown in FIG. 4 and thereafter by sewing the collar piece 40 to the front section 43 and folding them from the state as shown in FIG. 4, an upper collar 32 and a lapel 33 are formed as shown in FIG. 5. The front surfaces of the upper collar 32 and the lapel 33 are cloth material, while the rear surface side of the upper collar 32 is covered by the expansible and contractible interfacing 14 secured thereto and the rear surface side of the lapel 33 is covered by the first expansible and contractible interfacing 44 secured thereto.

Further, as is apparent from FIG. 4, the first expansible and contractible interfacing 44 or the second expansible and contractible interfacing 45 is existent at any position in the proximity of the overlapping edge area where buttons are fitted to the half-finished product and thereby the shape of the overlapping edge area can be maintained without any fear of loss of shape.

(Second Embodiment)

Figure 7:
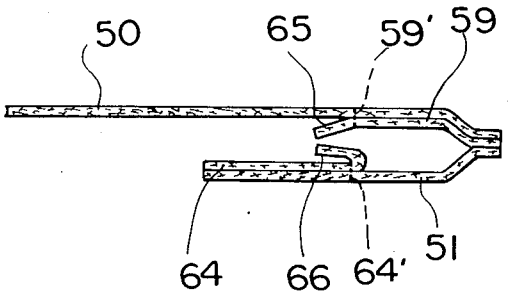
FIGS. 6 to 9 illustrate a garment in accordance with a second embodiment of the present invention.
Figure 6:
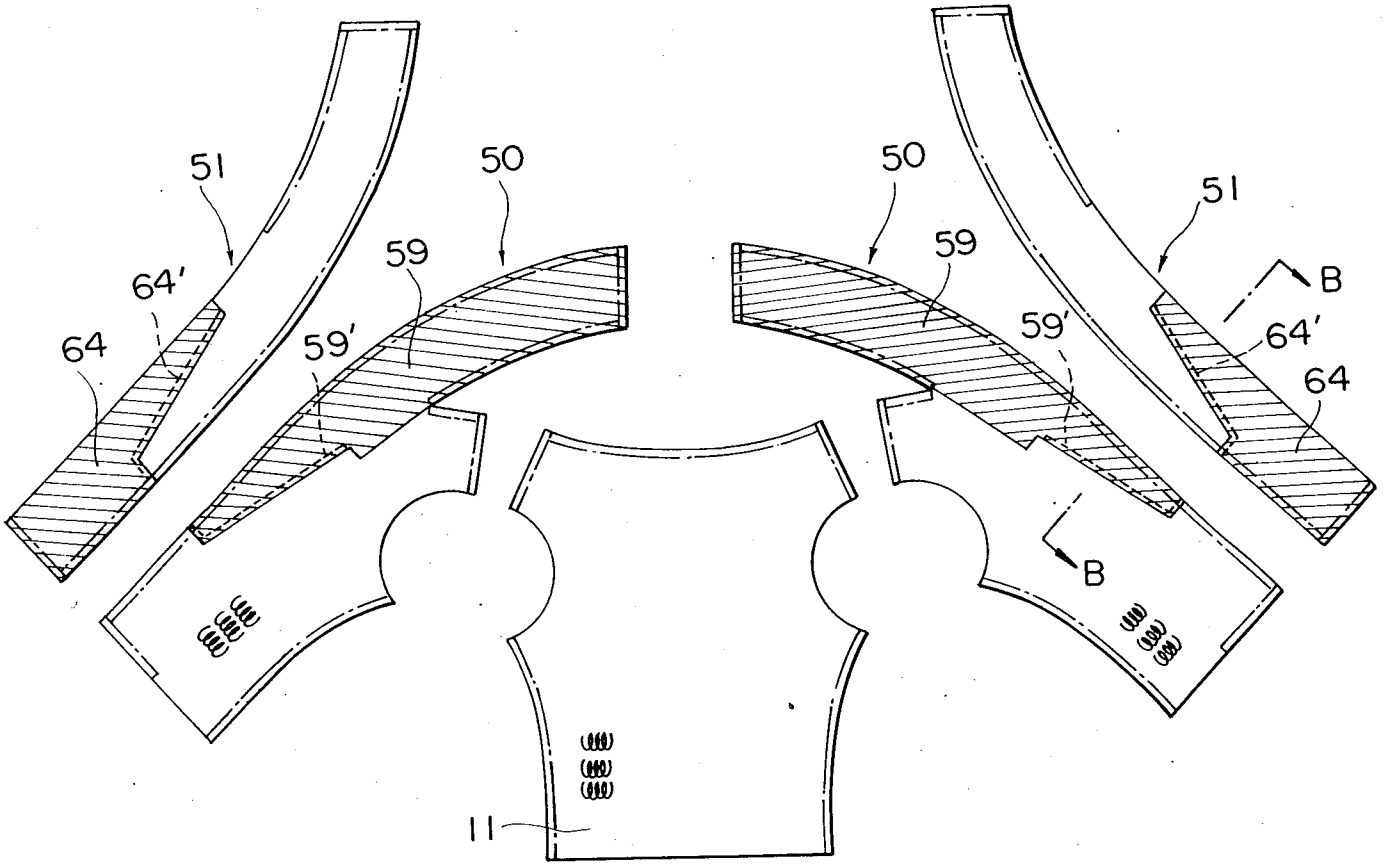
Figure 8:
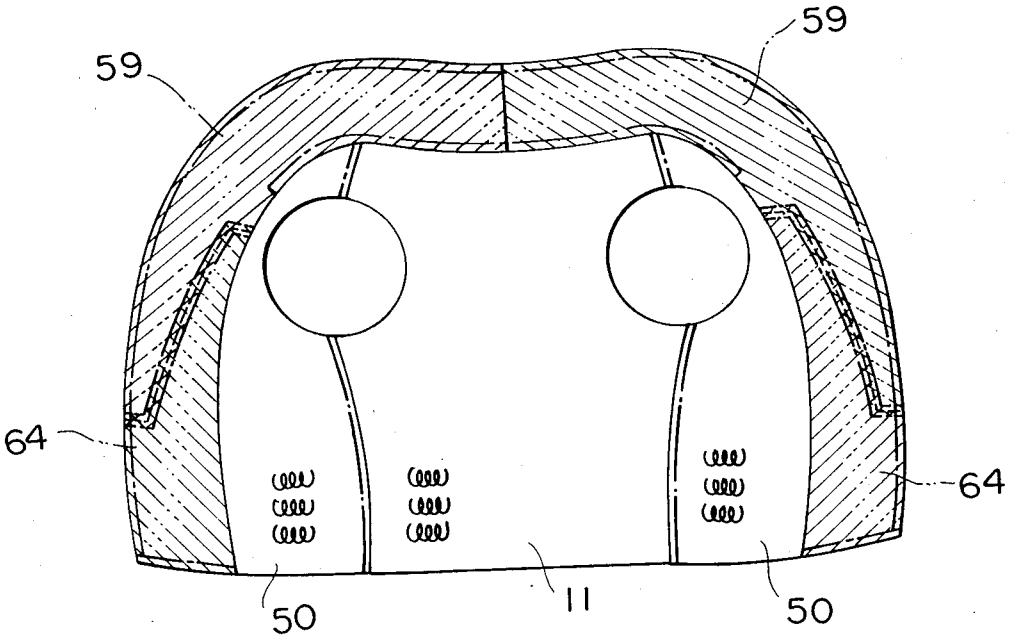
Figure 9:
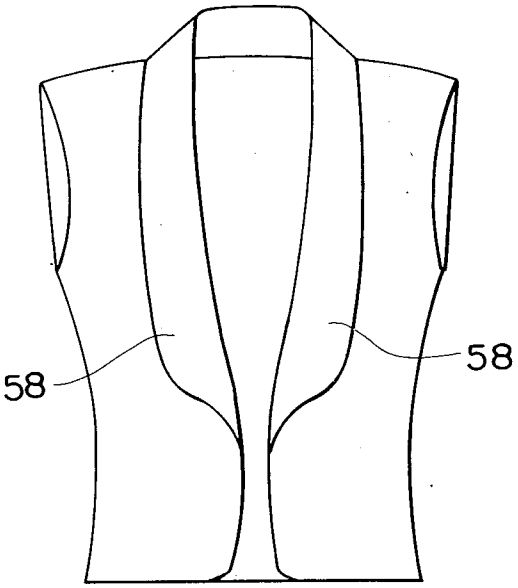

Next, description will be made below as to a garment in accordance with the second embodiment where the present invention is applied to a tuxedo with reference to FIGS. 6 to 9. FIG. 6 illustrates a plurality of cloth material pieces constituting a garment of the present invention in a disassembled state. FIG. 7 is an enlarged cross-sectional view taken in line B—B in FIG. 6, illustrating a front and a flyback having one outer edge secured thereto. FIG. 8 is a front view of a half-finished garment in an opened state, illustrating the manner in which the outer edges of the cloth materials shown. FIG. 6 are sewn together in. FIG. 9 is a front view of the garment which is obtained by folding the front backs from the state as shown in FIG. 8. In this embodiment the same reference numerals as those in the first embodiment represent the same part or element.

The garment is composed of five cloth material pieces comprising a back front 11, a pair of symmetrically shaped body pieces 50 and a pair of symmetrically shaped flyback pieces 51. The front piece 50 assumes a shape similar to a shape which is obtained by a integral combination of the upper part of the first body piece 22 and a half of the second collar piece 42 in the preceding embodiment. This front piece 50 is sewn to the back body 11, the other front piece 50 and the flyback piece 51.

With respect to the front piece 50 shown in FIG. 6 a first expansible and contractible interfacing 59 (an area represented by hatched lines—located on the upper surface side as seen in FIG. 6) is fitted to the entire area which becomes tuxedo collar 58 in FIG. 9. This first expansible and contractible interfacing 59 is locdated opposite to a part of the front piece 50 which is sewn to the back body piece 11 and has substantially the same width as that of the flyback 51. It is fitted to the front piece 50 midway of the area extending from the neck to the foot of the tuxedo.

On the other hand, the flyback 51 assumes a shape which is obtained by reversing the first piece 50 exclusive of a longitudinally extending area located in the proximity of the back body section 11. With respect to the flyback 51 no interfacing is fitted to the area which becomes the collar 58 in FIG. 9. A second expansible and contractible interfacing 64 (an area represented by hatched lines—the upper side as seen in FIG. 6) is fitted to the flyback 51 in the proximity of the foot and extending up the outer edge over an area which is not sewn to the body piece 50. The first expansible and contractible interfacing 59 and the second expansible and contractible interfacing 64 are fitted in such a manner that they are located on the inside when the first piece 50 and the flyback 51 are sewn together (corresponding to the state as shown in FIG. 8). The first expansible and contractible interfacing 59 is fitted with a L-shaped stitch 59' at a position appreciably inwardly of the edge located at the middle part of the front piece 50, in order to assure that it will not part away from the front piece 50. Also, the second expansible and contractible interfacing 64 is fitted with a L-shaped stitch 64' at a position appreciably inwardly of the edge located at the middle part of the flyback 51, in order to assure that it will not part away from the flyback 51.

As shown in FIG. 7, the first expansible and contractible interfacing piece 59 on the front piece 50 is formed with a first free end piece 65 with the aid of the stitch 59' whereby the free piece extends from the stitch 59' to the outer edge of the expansible and contractible interfacing piece 59. The second expansible and contractible free end piece 64 is formed with a second interfacing piece 66 with the aid of the stitch 64' whereby the free end piece extends from the stitch 64' to the outer edge of the second expansible and contractible interfacing piece 64. As is apparent from the drawing, the first free end piece 65 and the second free end piece 66 are sewn together in such a manner that the first free end piece 65 extends from the base part of the first interfacing piece 59 while the second interfacing piece 66 is folded back at the stitch 64'. While the front piece 50 and the flyback 51 are not sewn together directly in the proximity of stitches 59' and 64' the first free end piece 65 and the second free end piece 66 are sewn together.

With free end piece 66 folded second expaqnsible and contractible interfacing piuece 64 is it exerts a spring force on the second interfacing piece 66 and the aforesaid force functions to prevent flyback 51 from bending back further when a coller is formed. The first free end piece 65 and the second free end piece 66 are sewn together so that the front piece 50 does not not part away from the flyback piece 51. If a stitch 64 is located directly between the front piece 50 and the flyback piece 51, the result is that the front piece 50 and the flyback piece 51 do not have a degree of freedom. However, by allowing the first free end piece 65 and the second free end piece 66 to be sewn together, the front piece 50 and the flyback piece 51 can be joined to one another while maintaining their flexibility.

Incidentally, the first expansible and contractible interfacing 59 and the second expansible and contractible interfacing piece 64 may be adhesive interfacing for joining to the front piece 50 and the flyback piece 51 with the use of an adhesive. Further, the first free end piece 65 and the second free end piece 66 may be adhesive interfacing so that their facing surfaces can be adhesively joined together.

When the first interfacing piece 65 and the second interfacing piece 66 are sewn together and sewing margins on the cloth materials are sewn together, the state as shown in FIG. 8 is obtained from a state as shown in FIG. 6. Thereafter, by sewing the area which becomes a lapel and bending it from the state shown in FIG. 8, tuxedo lapels 58 as shown in FIG. 9 are obtained. The outside of the tuxedo lapel 58 is a surface to which no expansible and contractible interfacing is adhered while the inside of the tuxedo lapel 58 becomes a surface to which the first expansible and contractible interfacing 59 of the front piece 50 is fitted adhesively. Accordingly, the first expansible and contractible interfacing 59 assures that the shape of the tuxedo lapel 58 is not broken. Since no expansible and contractible interfacing is adhesively fitted to the outside of the tuxedo lapel 58, the latter can maintain a state of swelling.

(Third Embodiment)

Figure 10:
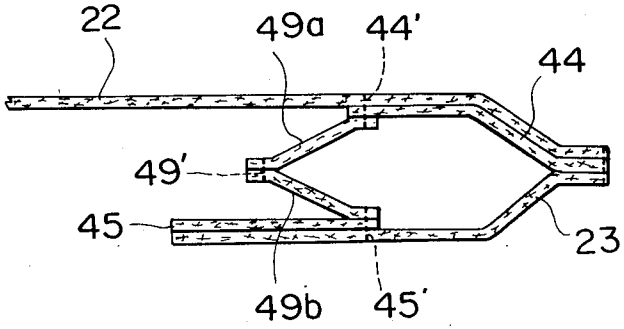
FIG. 10 is an enlarged cross-sectional view similar to FIG. 3, illustrating part of a garment in accordance with a third embodiment of the present invention.

Next, description will be made below as to a garment in accordance with a third embodiment of the present invention with reference to FIG. 10. FIG. 10 is a drawing which corresponds to FIG. 3 or FIG. 7. In the embodiment as shown in FIG. 3 the first interfacing free end piece 47 and the second interfacing free end piece 48 are sewn together. However, in the case where the first expansible and contractible interfacing 44 and the second expansible and contractible interfacing 45 are adhesive interfacings, the first expansible and contractible interfacing 44 adheres to the front piece 22 and the second expansible and contractible interfacing 45 is adhesively fitted to the flyback 23. Thus, the first free end piece 47 must be formed by peeling the end part of the first expansible and contractible interfacing 44 from the front body 22, and the second free end piece 48 must be formed by peeling the end part of the second expansible and contractible interfacing 45 from the flyback 23. This peeling operation is troublesome.

In the third embodiment as shown in FIG. 10, the first expansible and contractible interfacing 44 is adhesively fitted to the front body 22, and when a stitch 44' is formed, a first joint cloth **49*a* which is independent of the first expensible and contractible interfacing 44 is sewn to the first expansible and contractible interfacing 44 with the aid of the stitch 44'. Further, the second expansible and contractible interfacing 45 is adhesively fitted to the flyback 23, and when a stitch 45' is formed, a second joint cloth 49*b* which is independent of the second expansible and contractible interfacing 45 is sewn to the second expansible and contractible interfacing 45 with the aid of the stitch 45'. If the stitch 44' and the stitch 45' are not provided in that way, there would be the possibility that the firt expansible and contractible interfacing 44 and the second expansible and contractible interfacing 45 might peel off from the front body 22 and the flyback 23. Thereafter, the free end part of the first joint cloth 49*a* and the free end part of the second joint cloth 49*b* are seen together with the use of a stitch 49'**.

In this embodiment the front piece 22 is joined to the flyback 23 through the free end parts of the first and second joint cloths **49*a* and 49*b* which are independent of the first and second expansible and contractible interfacings 44 and 45. This arrangement makes it possible to improve workability much more than in the case where the adhesive layers located at the free end parts of the first and second expansible and contractible interfacings 44 and 45** are freed by peeling.

Incidentally, the first joint cloth **49*a* and the second joint cloth 49*b* may be adhesive clothes so that they may be adhesively joined to one another. Further, the material used for the first expansible and contractible interfacing 44 and the second expansible and contractible interfacing 45** is not limited only to an adhesive interfacing.

As described above, the garment of the invention is so constructed that a front surface which becomes a collar/lapel is not fitted with any expansible and contractible interfacing but its rear surface is fitted with an expansible and contractible interfacing for the purpose of preventing unshaping and the free end parts of the expansible and contractible interfacings are seen together with a free end interfacing portion on the body side folded back. Construction made in that way makes it possible to prevent unshaping of the collar/lapel. Since the front surface of the collar/lapel is constituted only by cloth material, the appearance of the collar can be improved by imparting swelling, that is, softness, to the collar.

By sewing together the free end parts of the expansible and contractible interfacings one of which is folded back, the lapel is biased outward. Thus, the problem of a lapel bending backwardly as seen with a conventional garment can be obviated.

Another advantageous effect of the present invention is that workability can be improved by fitting joint cloths which are independent of expansible and contractible interfacings to both the body side and the flyback side and then sewing together the joint cloths.

While the present invention has been described above with respect to three preferred embodiments thereof, it should of course be noted that is not limited only to the disclosed embodiments but various charges or modifications may be made in a suitable manner without departure from the scope of the invention as defined by the appended claims.

What is claimed is:

1. A garment comprising:

a body piece including a lapel portion;

a flyback joined to said lapel portion at one edge, said joined flyback and lapel portion being folded back against said body piece to form a lapel extending between the thus formed fold and said one edge;

a first expansible and contractible interfacing piece covering at least a portion of the surface of said lapel portion facing the flyback;

a second expansible and contractible interfacing piece covering at least a portion of the surface of said flyback facing said lapel portion, the opposite side of said flyback being free of interfacing material and forming the exterior surface of the folded lapel;

a first stitch, generally parallel to said one edge, joining said first interfacing piece to said body piece, said first interfacing piece extending between said one edge and said first stitch and beyond said first stitch to form a first free end portion;

a second stitch, generally parallel to said one edge, joining said second interfacing piece to said flyback, said second interfacing piece extending from the edge of said flyback opposite said one edge to said second stitch and beyond said second stitch to form a second free end, said second free end being folded back upon itself and joined to said first free end, said folded second free end urging said lapel outwardly to retain its shape.

2. The garment of claim 1 wherein the first and second interfacings are adhesive interfacings.

3. A garment comprising:

a body piece including a lapel portion;

a flyback joined to said lapel portion at one edge, said joined flyback and lapel portion being folded back against said body piece to form a lapel extending from the thus formed fold to said one edge;

a first expansible and contractible interfacing piece covering at least a portion of the surface of said lapel portion facing the flyback;

a second expansible and contractible interfacing piece covering at least a portion of the surface of said flyback facing said lapel portion, the opposite side of said flyback being free of interfacing material and forming the exterior surface of said lapel;

first and second joint pieces;

a first stitch, generally parallel to said one edge, joining said first interfacing piece and said first joint piece to said body piece, said first interfacing piece extending between said one edge and said first stitch, said first joint piece extending from said first stitch away from said one edge, and terminating at a second edge;

a second stitch, generally parallel to said one edge, joining said second interfacing piece and said second joint piece to said body piece, said second joint piece extending from said second stitch, away from said one edge, and terminating at a second edge;

said second edges of said first and second joint pieces being joined together so that said joint pieces urge said lapel outwardly to retain its shape.

4. A garment in accordance with claim 3 wherein said first and second interfacing pieces are adhesive interfacing.

5. A garment in accordance with claim 3 wherein said first and second joint cloths are adhesive cloth.

* * * * *

UNITED STATES PATENT AND TRADEMARK OFFICE

CERTIFICATE OF CORRECTION

PATENT NO. : 4,796,305 PAGE 1 OF 2

DATED : January 10, 1989

INVENTOR(S) : Mitsuru ITOH

It is certified that error appears in the above-identified patent and that said Letters Patent is hereby corrected as shown below:

IN THE ABSTRACT:

Lines 1, 5 and 7, "llapel" should read --/lapel--; and

Line 23, "switch" should read --stitch--.

IN THE SPECIFICATION:

Col. 1, line 20, "loose" should read --lose--;

line 55, delete "a" insert --the--.

Col. 2, lines 43-44, delete "and free ends of the enpansible so as to leave" and insert --so as to leave free ends of the expansible and--.

Col. 4, line 41, delete "2" and insert --1--.

UNITED STATES PATENT AND TRADEMARK OFFICE

CERTIFICATE OF CORRECTION

PATENT NO. : 4,796,305

DATED : January 10, 1989

INVENTOR(S) : Mitsuru ITOH

It is certified that error appears in the above-identified patent and that said Letters Patent is hereby corrected as shown below:

Col. 6, line 13, delete "locdated" insert --located--.

Col. 8, line 2, "firt" should read --first--;

line 7, "seen" should read --sewn--.

Signed and Sealed this

Twenty-third Day of January, 1990

*Attest:*

JEFFREY M. SAMUELS

*Attesting Officer*

*Acting Commissioner of Patents and Trademarks*